US006735894B2

(12) United States Patent
Crusenberry et al.

(10) Patent No.: US 6,735,894 B2
(45) Date of Patent: May 18, 2004

(54) TAG ENCASEMENT

(75) Inventors: Stephen M. Crusenberry, San Jose, CA (US); Tilak B. Dissanayake, Palo Alto, CA (US); Debra A. Young, San Jose, CA (US)

(73) Assignee: The Silverhills Group, LLC, Albuquerque, NM (US)

( * ) Notice: Subject to any disclaimer, the term of this patent is extended or adjusted under 35 U.S.C. 154(b) by 9 days.

(21) Appl. No.: 09/982,374

(22) Filed: Oct. 17, 2001

(65) Prior Publication Data

US 2003/0070340 A1 Apr. 17, 2003

(51) Int. Cl.[7] ..... G09F 3/20

(52) U.S. Cl. ..... 40/654.01; 40/300; 40/661

(58) Field of Search ..... 40/1.5, 1.6, 300, 40/303, 642.02, 654.01, 661, 661.05, 661.08, 665; 119/858; 224/240

(56) References Cited

U.S. PATENT DOCUMENTS

| | | | | | |
|---|---|---|---|---|---|
| 1,128,136 | A | * | 2/1915 | Hano | 150/147 |
| 1,262,447 | A | | 4/1918 | Carr | |
| 1,359,319 | A | * | 11/1920 | Brenan | 150/136 |
| 1,452,250 | A | | 4/1923 | Moore et al. | |
| 1,521,897 | A | * | 1/1925 | Martin | 383/20 |
| 1,539,744 | A | | 5/1925 | Kelly | |
| 2,097,070 | A | | 10/1937 | Lago | |
| 2,219,511 | A | * | 10/1940 | Coolbroth | 150/136 |
| 2,540,718 | A | | 2/1951 | Duskin | |
| 2,546,815 | A | * | 3/1951 | Baird | 150/141 |
| 2,648,150 | A | | 8/1953 | Sullivan | |
| 2,680,315 | A | | 6/1954 | McHugh et al. | |
| 3,429,065 | A | | 2/1969 | Long et al. | |
| 3,548,907 | A | * | 12/1970 | Boldt | 150/149 |
| 3,584,349 | A | * | 6/1971 | Shubart | 24/113 MP |
| 3,585,743 | A | | 6/1971 | Jeffers | |
| 3,782,017 | A | | 1/1974 | Graham | |
| D232,135 | S | * | 7/1974 | Dodson | D3/230 |
| 3,871,336 | A | | 3/1975 | Bergman | |
| 3,970,130 | A | * | 7/1976 | Casey | 150/149 |
| 4,137,660 | A | | 2/1979 | Dettmann et al. | |
| 4,178,879 | A | | 12/1979 | Cunningham | |
| 4,259,798 | A | | 4/1981 | McConnell | |
| 4,464,798 | A | * | 8/1984 | Livingstone | 2/247 |
| 4,530,175 | A | | 7/1985 | Wellman | |
| 4,616,435 | A | | 10/1986 | Perfect | |
| 4,739,566 | A | | 4/1988 | Smith | |
| 4,850,731 | A | * | 7/1989 | Youngs | 206/308.1 |
| 4,852,783 | A | * | 8/1989 | Bryden et al. | 224/684 |
| 4,991,338 | A | | 2/1991 | Jones | |
| 5,129,614 | A | | 7/1992 | Kohl | |
| 5,233,942 | A | | 8/1993 | Cooper et al. | |
| 5,381,617 | A | | 1/1995 | Schwartztol et al. | |
| 5,429,393 | A | | 7/1995 | Parlo | |
| 5,477,633 | A | | 12/1995 | Leinberger | |
| 5,497,733 | A | | 3/1996 | Hull et al. | |
| 5,676,093 | A | | 10/1997 | Sporn | |
| 5,718,192 | A | | 2/1998 | Sebastian | |
| 5,752,633 | A | * | 5/1998 | Antaki | 224/222 |
| 6,367,426 | B1 | | 4/2002 | Schaible | |

FOREIGN PATENT DOCUMENTS

| | | |
|---|---|---|
| AU | B-6422/80 | 1/1985 |
| DE | 201 07 445 U 1 | 10/2001 |
| JP | 9-191789 | 7/1997 |

* cited by examiner

*Primary Examiner*—Brian K. Green
(74) *Attorney, Agent, or Firm*—Beyer Weaver & Thomas LLP

(57) ABSTRACT

A tag encasement has an envelope having a pocket portion with a first surface and a second surface together forming an enclosure and an opening along one side of the pocket portion. A slot is disposed through the first surface of the pocket portion for receiving a tag, a flap portion is foldably coupled to the pocket portion for closing the opening and the slot, and a releasable fastener to hold the flap portion releasably closed against the pocket portion is disposed on the first surface of the pocket portion and on the flap portion.

25 Claims, 6 Drawing Sheets

TAG ENCASEMENT

FIELD OF THE INVENTION

The present invention relates to a tag encasement.

BACKGROUND OF THE INVENTION

Certain animals are required to wear tags around their neck for various reasons. Pet dogs are often required by law to be registered or licensed in the county or state where the pet lives. Moreover, most jurisdictions also require the pet to wear a tag evidencing a vaccination against rabies. In many jurisdictions, the laws also require that these vaccination tags, and/or registration tags, be replaced periodically.

Pet owners also frequently attach supplemental identification tags to a pet's collar. These identification tags are typically engraved with the pet's name, and the owner's name, address, and phone number. Some owners also attach a tag containing medical information, such as veterinarian information and any medication that the pet must regularly take.

Thus, some pets can wear as many as three or more pet tags attached to their collars. However, there are many disadvantages to wearing these pet tags. Pet tags are commercially constructed in various shapes of rigid materials such as metal or hard plastic. Thus, single or multiple pet tags knock and rub against hard objects, such as food bowls, non-carpeted floors, or the car window such as when the pet has its head out of the car window. Having multiple tags also causes the tags to knock and rub against each other. This contact of the tags with hard objects and with each other produces undesirable noise. This is even more annoying for hunting dogs because the pet tags or collars must be removed from the dogs on every hunt since the dogs must work as quietly as possible.

Moreover, pet tags rubbing against each other and against other hard objects produces accelerated wear on the pet tag engravings, as does repeated or continual exposure to dirt, rain, and other environmental influences. This requires that the owner repeatedly replace the tags or, if the owner does not notice that this wear has occurred, may result in a lost pet not being returnable to the owner because the identification information cannot be read.

Furthermore, metal tags can cause fur discoloration on light-colored pets.

Additionally, tags can become entangled on fences or other objects resulting in injury or death to the animal wearing the tags.

Another disadvantage is that many owners occasionally or frequently travel with their pets such that the information contained on the tags, such as the phone number, becomes temporarily invalid. Additionally, people frequently move, thus changing addresses. This requires that new tags must be ordered, which could take several weeks. In the meantime, owners typically write new or temporary information on delicate material, such as paper or cardboard and attach it to the pet's collar or a tag hook, where the information is easily damaged or destroyed.

Moreover, current tags, in general, are unattractive.

Furthermore, commercially available tags are usually supplied to the owner with a small split ring or, less frequently, with an S-hook (all tag hook devices are referred to as "tag hook(s)"). The tag hook attaches to the tag through a hole at the top of the tag. The owner then typically attaches the tag to a collar by attaching the tag hook to a metal ring or other connecting device integrated in the collar. Attaching or removing the tags from the tag hooks is bothersome and difficult for most owners, especially for those having longer fingernails, or arthritis of the hands or fingers.

The need to address the disadvantages above have been unsuccessfully addressed by current tag holder devices for many reasons. Unless the pet-tag holder is being applied prior to the pet tags having been attached to the collar, current devices require detachment of the tag hooks from the collar and detachment of the tags from the tag hooks in order to apply the tag holder. Some also require removal of the pet's collar in order to change the pet tags.

Moreover, because some tag holders attach to the collar and the tags are encased within the holder rather than remaining securely attached to the pet's collar, should the tag holder become damaged or accidentally separated from the pet's collar, the tags may be lost.

Furthermore, it is not possible to use many of the current tag holders on narrow pet collars or on fabric or metal 'choke' collars since the width of the holder is too wide for the narrow collars. In some cases, such as where the holder must be riveted to the pet collar, there is no means by which the holder can be attached to such a collar. Furthermore, even if the holder is capable of being attached to a choke collar, the collar cannot be threaded through its end loops to create the sliding action required of such collars.

Additionally, most current tag holders are designed to hold only one or two pet tags.

Current tag holders are not designed to effectively hold the various sizes, thickness, and styles of pet tags commonly on the market today, including legally required registration and vaccination tags. Most, in fact, are extremely restrictive as to the shape of tags they can accommodate, many being limited to a narrow, elongated pet tag, and/or to a flexible pet tag, which are not the commonly used or available commercial tags.

Another disadvantage of current tag holders is that when a pet plays with another playmate, it instinctively protects its throat from "play-bites" from the playmate on the sides and back, or nape, of its neck. Some tag holders slide along the length of the pet's collar, or move with the pet collar as it slides around the pet's neck. Thus, these holders are likely to be repeatedly bitten or chewed by the playmate, thus rendering the holder susceptible to coming open or detached and to accelerated deterioration. Additionally, the majority of these holders are constructed of rigid materials, which could cause damage to the animal's teeth.

Moreover, the design of many current tag holders exposes the tags to the elements and/or does not enable a natural escape of loose dirt or water from the holder's interior. This causes increased tag deterioration from ongoing exposure to such elements.

Furthermore, some tag holders require one or more rivets to be attached to the collar, thus forcing the owner to make holes in the collar, thereby limiting the type of collar that can be used. It also requires the owner to apply and/or operate these rivets in order to attach the tag holder to the collars.

Additionally, most devices are constructed of rigid material, with some of them protruding out from the pet's collar and/or hanging from the collar. Thus, while the noise associated with the tags striking each other or other hard objects is abated, a noise problem persists caused by the tag holder itself striking hard objects. Use of rigid materials also means that the tag holders cannot be laundered but must be cleaned by hand. Furthermore, the use of metal or hard plastic in most holders presents a potential health risk to the pet should the holder be chewed or ingested.

Moreover, the size and/or weight of some current tag holders render them impractical for use on small pets with necks close to the ground or incapable of comfortably carrying the additional weight of the holder.

Furthermore, most tag holders either do not enable a owner to easily contain a temporary personalized tag (i.e. constructed of, for example, cardboard or paper containing pet information) or provide the capability to reasonably protect the temporary tag from the elements.

None of the prior art addresses the established problems associated with wearing tags for pets and their owners. Thus, there is a need for a pet tag holder that address all the disadvantages of current tag holders.

BRIEF DESCRIPTION OF THE INVENTION

A tag encasement has an envelope having a pocket portion with a first surface and a second surface together forming an enclosure and an opening along one side of the pocket portion. A slot is disposed through the first surface of the pocket portion for receiving a tag, a flap portion is foldably coupled to the pocket portion for closing the opening and the slot, and a releasable fastener to hold the flap portion releasaly closed against the pocket portion is disposed on the first surface of the pocket portion and on the flap portion.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

In the drawings.

DETAILED DESCRIPTION

Embodiments of the present invention are described herein in the context of a pet tag encasement. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, or different design specifications, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
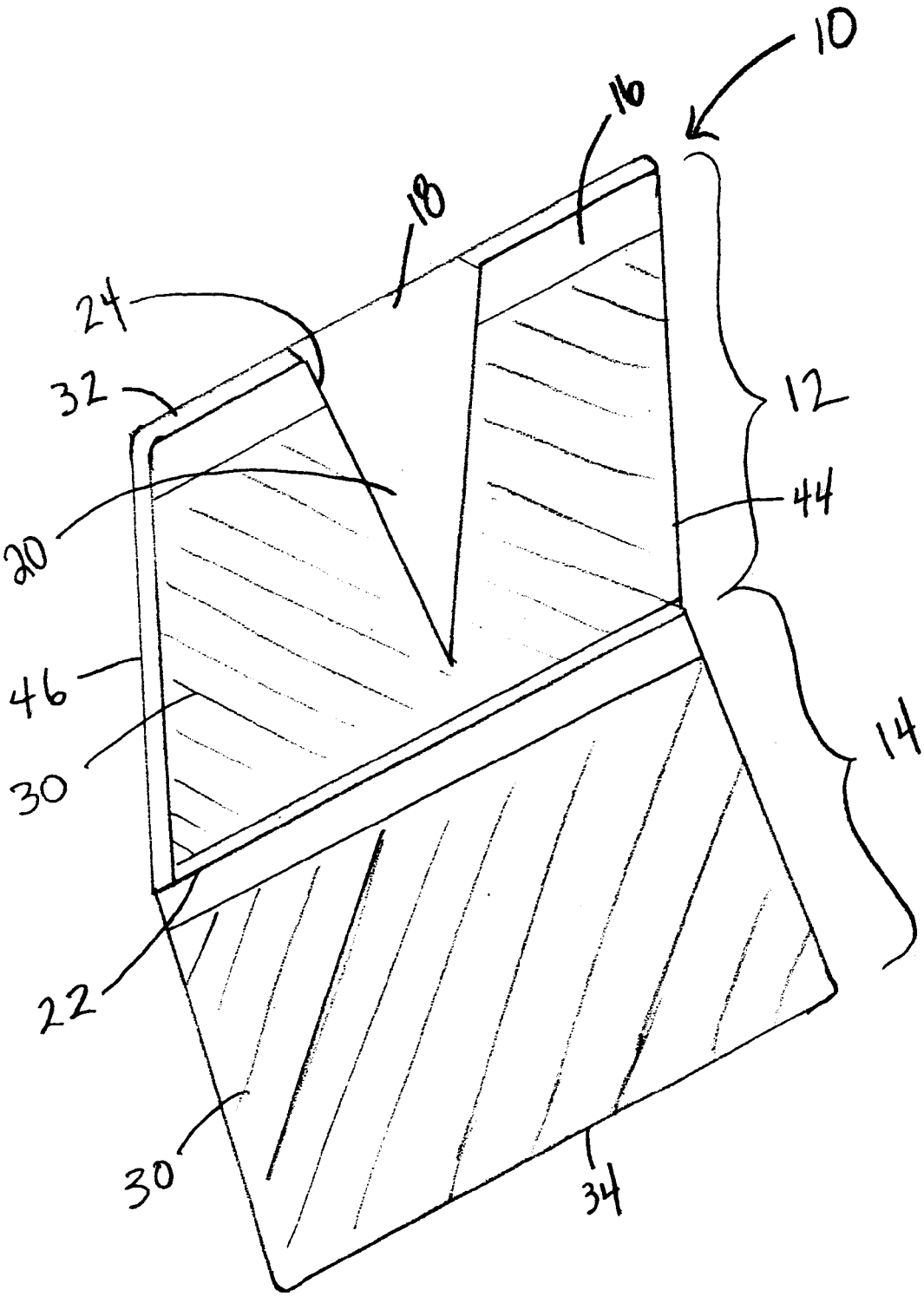
FIG. 1 shows a pet-tag encasement in the open position in accordance with one embodiment of the present invention.
Figure 2:
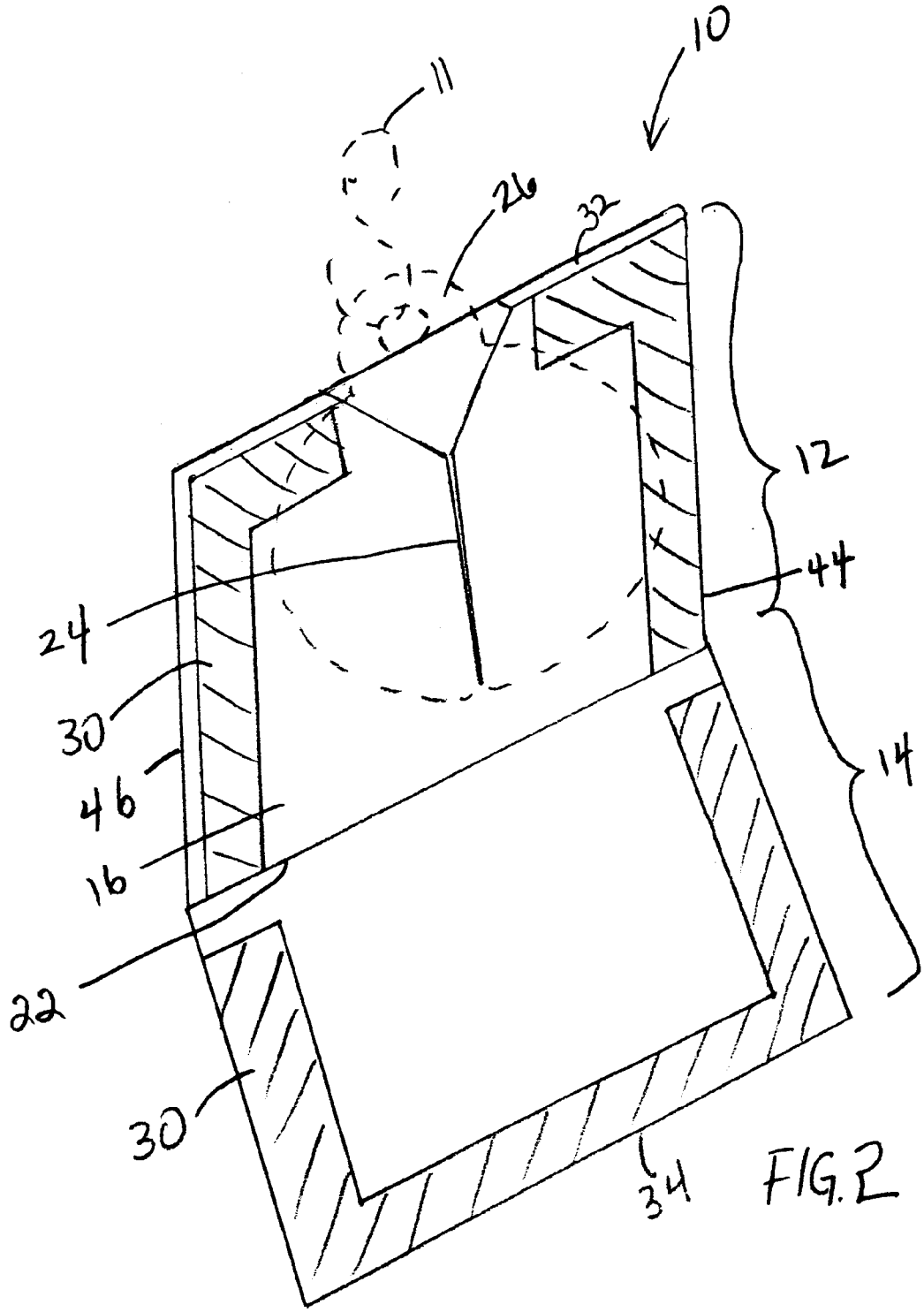
FIG. 2 shows a pet-tag encasement in the open position in accordance with a second embodiment of the present invention.
Figure 3:
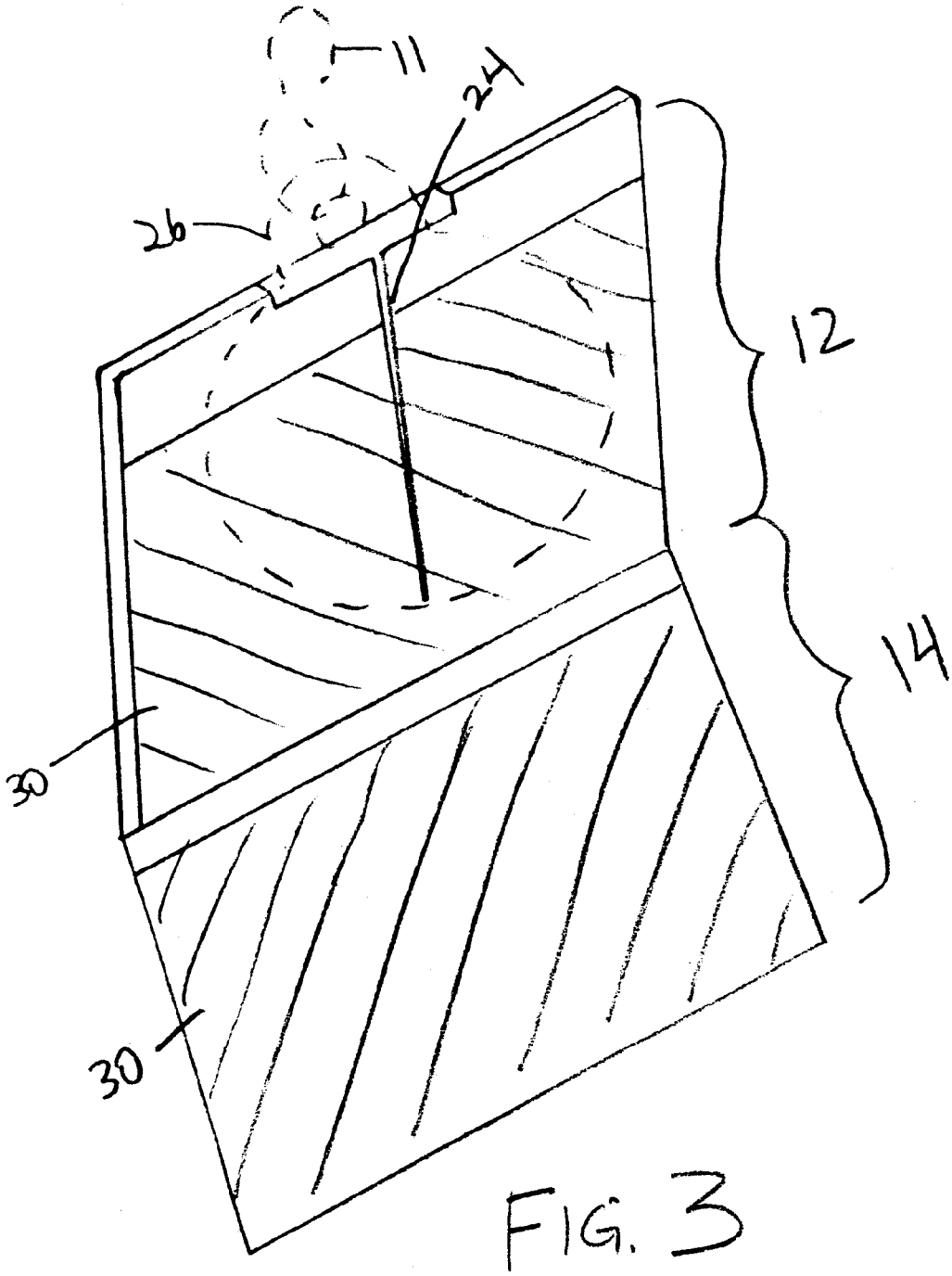
FIG. 3 shows a pet-tag encasement in the open position in accordance with a third embodiment of the present invention.

Referring to FIGS. 1–3, an embodiment of the pet tag encasement, generally numbered as 10, has a pocket portion 12 and a flap portion 14. The pocket portion has a first surface 16 and a second surface 18 together forming an enclosure 20 and an opening 22 along one side of the pocket portion 12.

The pet tag 26 (shown in shadow in FIG. 2) is disposed within the enclosure 20. The opening 22 allows for easy access to the tags, easy removal of collected dirt, water, etc., and allows for easy access to dispose the tags within the enclosure. The opening 22 further allows for easy access to the tags for a person to view the information contained on each tag.

A slot 24 is disposed through the first surface 16 of the pocket portion 12 and is opposite the opening 22. The slot 24 allows a pet tag 26 to be easily disposed within the enclosure 20 without having to take the tag 26 off a collar. The slot 24 also allows for easy access to view the information contained on the first tag. Thus, the disadvantage of current tag holders requiring the detachment of the tag hooks from the collar and detachment of the tags from the tag hooks in order to apply the tag holder is overcome. Some tag holder also require removal of the pet's collar in order to change the pet tags, which is not required in the claimed invention. Moreover, since some tag holders attach to the collar and the tags are encased within the holder rather than remaining securely attached to the pet's collar, should the tag holder become damaged or accidentally separated from the pet's collar, the tags may be lost. This loss is not likely with the presently claimed invention. Of course, those of ordinary skill in the art will realize that the tag may be disposed into the enclosure 20 in a variety of ways. For example, a user may choose to take the tag off the collar, insert the tag up through the opening, and reattach the tag to the collar using the tag hook 11.

The slot 24 may take the form of several shapes which allows a tag 26 to be securely disposed within the enclosure 20. To be securely disposed within the enclosure, the slot 24 must be in a shape which allows the "shoulders" of the tag to rest on the top 32 of the tag encasement 10 and minimize the likelihood of the tag encasement being separated from the tags, i.e. the width of the slot 24 is less than the width of enclosure 20. As shown in FIG. 1, the slot may be a "V" shape. The slot may also be a "Y" shape as shown in FIG. 2 or a "T" shape as shown in FIG. 3.

The tag encasement 10 further comprises a flap portion 14 foldably coupled to the pocket portion 12. The flap portion 14 closes the opening 22 and slot 20. This allows for a secure enclosure of the tags and/or any temporary information tags such as handwritten information cards. Moreover, to remove any dirt, water, etc. build-up in the tag encasement, the flap portion 14 may be opened and the dirt, water, etc. is easily released from the opening 22. To releaseably close the flap portion 14 to the pocket portion 12, any type of releaseable fasteners known in the art may be used. As shown in FIGS. 1–3, the preferred releaseable fastener is hook and loop material 30 which is safer for the animals. The hook and loop material 30 is disposed on the flap portion 14 and first surface 16 of the pocket portion 12. Those of ordinary skill in the art will realize that any type of releaseable fastener may be used such as snaps, buttons, zippers, and the like.

In one embodiment, the pet tag encasement is made from a flexible, durable fabric. However, other materials such as leather, plastic, or the like may be used. Moreover, all or portions of the pet tag encasement may be formed of light-reflective material to provide added protection to an animal at night. Those of ordinary skill in the art will realize that the tag encasement may be made from a variety of materials. For example, the tag encasement may be made from a flexible, durable fabric and the tag encasement may be banded with light-reflective material along the first side 46, second side 44, and bottom 34. Banding of the tag encasement prevents fraying of the material and increases durability of the tag encasement. Thus, the slot may also be banded. Of course, those of ordinary skill in the art will realize that the tag encasement 10 may be banded with any type of material such as the flexible, durable fabric, leather, and the like. Moreover, the tag encasement may include an inner liner (not shown) to allow for extra durability of the tag encasement.

Although the preferred embodiments shown in the figures are rectangular in shape, those of ordinary skill in the art will now realize that the tag encasement may take the form of any other shape such as a square, oval, round, and the like. Furthermore, the flap portion may be designed to any shape such as a bow tie.

Figure 4:
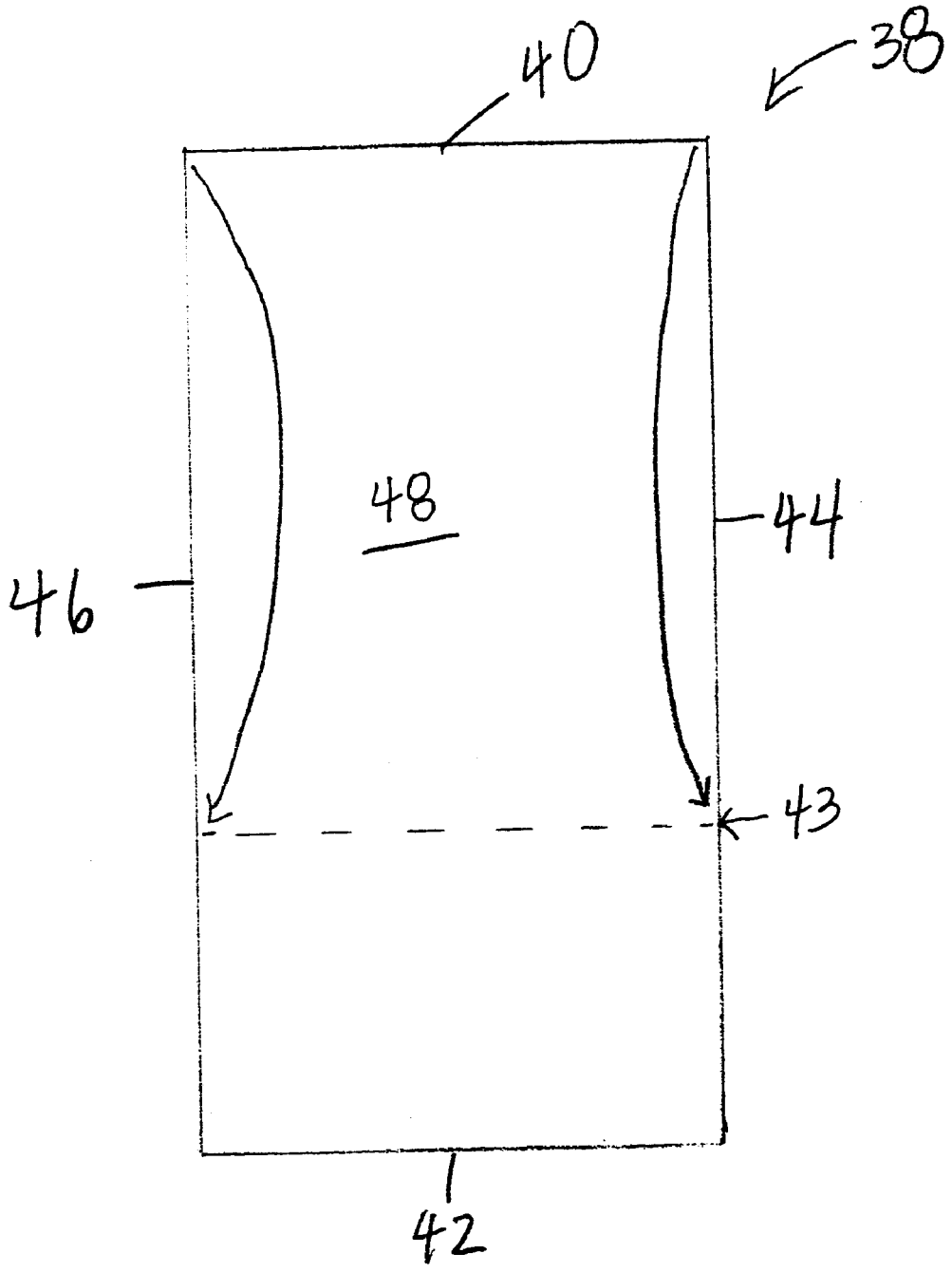
FIG. 4 shows a sheet of material used to fabricate a pet tag in accordance with the present invention.
Figure 5:
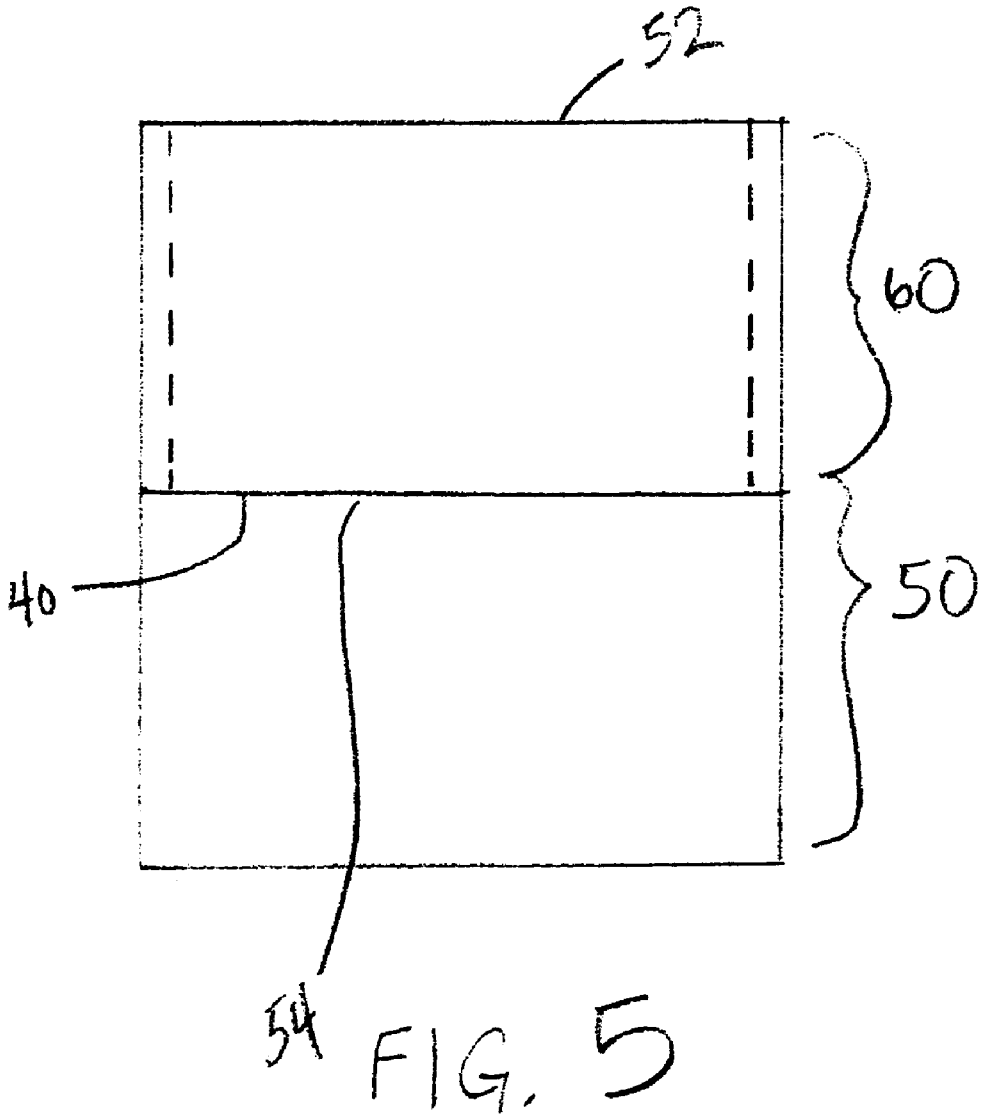
FIG. 5 is a front elevation showing the assembly of the front surface of a pet tag encasement in accordance with an embodiment of the present invention.
Figure 6:
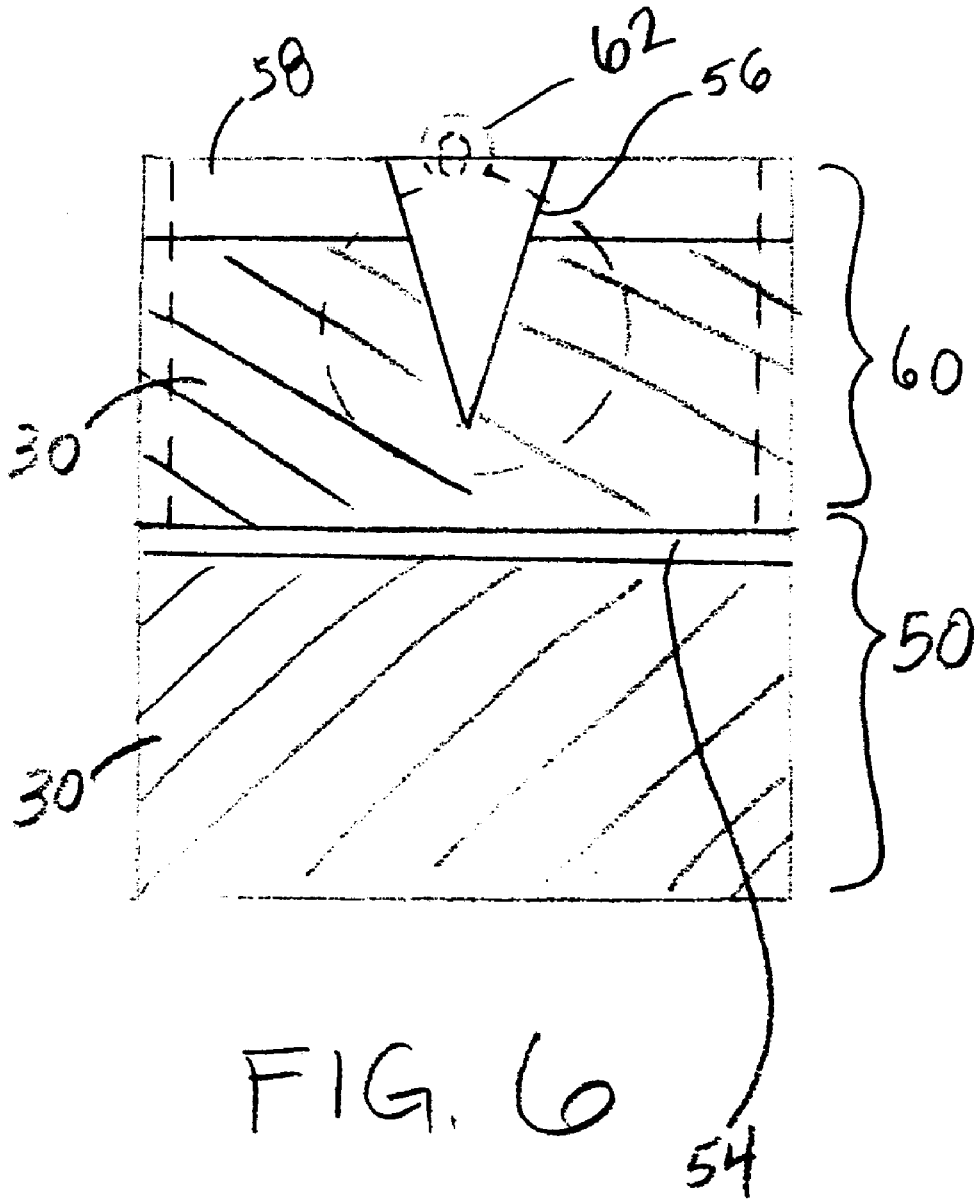
FIG. 6 is a front elevation showing the formation of the slot and attachment of releasable fastener of a pet tag encasement in accordance with an embodiment of the present invention.

As illustrated in the embodiment of FIGS. 4–6, the present invention also provides for a method of making the pet tag encasement from a single sheet of material 38 having a top side 40, a bottom side 42, first side 46, a second side 44, and a top surface 48. The top side 40 is folded to a predetermined fold line 43 that is preferably two-thirds the total length of the sheet of material 38. This forms the flap portion 50, pocket portion 60, and a fold side 52. The first side 46 and second side 44 are sewn from the top side 40 to the fold side 52 which thereby forms an opening 54 and the enclosure. The opening 22 allows for easy access to the tags, easy removal of collected dirt, water, and the like, and allows for easy access to dispose the tags within the enclosure. The opening 54, which is substantially the width of the pocket portion 60, further allows for easy access to the tags for a person to view the information contained on each tag.

As shown in FIG. 6, a slot 56 is formed on the first surface 58 and fold side 52 of the pocket portion 60. The slot 56 allows a pet tag 62 to be easily disposed within the pocket portion 60 without having to take the tag 62 off from a collar. The slot 56 also allows for easy access to view the information contained on the first tag. Thus, the disadvantage of current tag holders requiring the detachment of the tag hooks from the collar and detachment of the tags from the tag hooks in order to apply the tag holder is overcome. Some tag holders also require removal of the pet's collar in order to change the pet tags, which is not required in the claimed invention. Moreover, since some tag holders attach to the collar and the tags are encased within the holder rather than remaining securely attached to the pet's collar, should the tag holder become damaged or accidentally separated from the pet's collar, the tags may be lost. This loss is not possible with the presently claimed invention. Of course, those of ordinary skill in the art will realize that the tag may be disposed into the pocket portion 60 in a variety of ways. For example, a user may chose the take the tag off the collar, insert the tag up through the opening, and reattach the tag to the collar using the tag hook 11.

The slot 56 may take the form of several different shapes which allows a tag 62 to be securely disposed within the pocket portion 60. To be securely disposed within the enclosure, the slot 24 must be in a shape which allows the "shoulders" of the tag to rest on the top 32 of the tag encasement 10 and minimize the likelihood of the tag encasement being separated from the tags. As shown in FIG. 6, the slot may be a "V" shape. However, as shown in FIGS. 2 and 3, the slot may also be a "Y" or a "T" shape.

The flap portion 50 closes the opening 54 and slot 56. This allows for a secure of the tags and/or any temporary information tags such as handwritten information cards. Moreover, to remove any dirt, water, etc. build-up in the tag encasement, the flap portion 50 may be opened and the dirt, water, etc. is easily released from the opening 54. To releaseably close the flap portion 50 to the pocket portion 60, any type of releaseable fasteners known in the art may be used. As shown in FIG. 6, the preferred releaseable fastener is hook and loop material 30 which is safer for the animals. The hook and loop material 30 is attached to the flap portion 50 and pocket portion 60. Those of ordinary skill in the art will realize that any type of releaseable fastener may be used such as snaps, buttons, zippers, and the like.

The pet tag encasement may be made from a flexible, durable fabric. However, other materials such as leather, plastic, or the like may be used. Moreover, all or portions of the pet tag encasement may be formed of light-reflective material to provide added protection to an animal at night. Those of ordinary skill in the art will now realize that the tag encasement may be made from a variety of materials. For example, the tag encasement may be made from a flexible, durable fabric and the tag encasement may be banded with light-reflective material along the first side 46, second side 44, and bottom 34. Banding of the tag encasement prevents fraying of the material and increases durability of the tag encasement. Thus, the slot may also be banded. Of course, those of ordinary skill in the art will realize that the tag encasement 10 may be banded with any type of material such as the flexible, durable fabric, leather, and the like. Moreover, the tag encasement may comprise of an inner liner (not shown) to allow for extra durability of the tag encasement.

Although the embodiments shown in the figures are rectangular in shape, those of ordinary skill in the art will now realize that the tag encasement may be made in any other shape such as a square, oval, round, and the like. Furthermore, the flap portion may be designed to any shape such as a bow tie.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims.

What is claimed is:

1. A tag encasement, comprising:

an envelope having a pocket portion having a first surface and a second surface together forming an enclosure and a first opening disposed along a first side of said pocket portion;

a slot disposed through said first surface of said pocket portion, said slot extending from a second opening along a second side of said pocket portion opposite said first opening, said second side being longer than said second opening, wherein said slot and said second opening are operable together to receive and secure a tag which is wider than the second opening within the enclosure;

a flap portion foldably coupled to the pocket portion for closing said first opening and said slot; and a first releasable fastener disposed on said first surface of said pocket portion and a second releasable fastener disposed on said flap portion for holding said flap portion releasably closed against said pocket portion.

2. The tag encasement of claim 1 wherein said tag is disposed within said enclosure.

3. The tag encasement of claim 1 wherein said slot and said second opening form a "T" shape.

4. The tag encasement of claim 1 wherein said slot and said second opening form a "Y" shape.

5. The tag encasement of claim 1 wherein said slot and said second opening form a "V" shape.

6. The tag encasement of claim 1 wherein said first releasable fastener and said second releasable fastener comprises hook and loop material.

7. The tag encasement of claim 1 wherein said tag encasement is formed of a light-reflective material.

8. The tag encasement of claim 1 wherein said tag encasement is formed of a plastic material.

9. The tag encasement of claim 1 wherein said tag encasement is formed of a durable fabric.

10. The tag encasement of claim 1 wherein said tag encasement is formed of a leather material.

11. A tag encasement, comprising a first surface and a second surface together forming an enclosure having a first opening along a first edge thereof, the first edge being longer than the first opening, the first surface having a slot therein leading from the first opening, the slot and the first opening being operable together to receive and secure a tag which is wider than the first opening within the tag encasement, the enclosure further comprising a second opening along a second edge thereof opposite the first opening from which the slot leads, the second opening being substantially the same length as the second edge of the enclosure and facilitating access to the tag.

12. The tag encasement of claim 11 further comprising securing material for at least partially closing the first opening and slot thereby further securing the tag in the tag encasement.

13. The tag encasement of claim 12 wherein at least a portion of the securing material is permanently secured to one of the first and second surfaces.

14. The tag encasement of claim 12 wherein the securing material is contiguous with at least one of the first and second surfaces.

15. The tag encasement of claim 14 wherein the securing material is contiguous with both of the first and second surfaces.

16. The tag encasement of claim 17 further comprising a releasable fastening mechanism for releasably fastening the securing material to the first surface of the enclosure.

17. The tag encasement of claim 16 wherein the releasable fastening mechanism comprises hook and loop material.

18. The tag encasement of claim 11 wherein the first opening and the slot form a "T" shape.

19. The tag encasement of claim 11 wherein the slot is a "Y" shape.

20. The tag encasement of claim 11 wherein the slot is a "V" shape.

21. The tag encasement of claim 11 wherein at least one of the first and second surfaces comprises at least one of a reflective material, a plastic material, a durable material, and a leather material.

22. The tag encasement of claim 11 wherein the enclosure is one of substantially rectangular, substantially circular, and substantially oval.

23. The tag encasement of claim 11 wherein the first and second surfaces are portions of a single piece of folded material.

24. The tag encasement of claim 23 further comprising a flap for at least partially closing the first opening and slot thereby further securing the tag in the tag encasement.

25. The tag encasement of claim 24 wherein the flap also comprises a portion of the single piece of folded material.

* * * * *